United States Patent [19]

Nakatsuka

[11] 4,145,582

[45] Mar. 20, 1979

[54] MOVING COIL PICKUP HAVING A SUBSTANTIALLY SQUARE MAGNETIC ARMATURE MOUNTED IN AN AIR GAP ADJACENT A SQUARE FACE MAGNETIC MEMBER

[75] Inventor: Hisayoshi Nakatsuka, Greve Strand, Denmark

[73] Assignee: Ortofon Manufacturing A/S, Valby, Denmark

[21] Appl. No.: 676,350

[22] Filed: Apr. 12, 1976

[30] Foreign Application Priority Data

Apr. 15, 1975 [JP] Japan ..... 50-44888

[51] Int. Cl.[2] ..... H04R 9/16

[52] U.S. Cl. ..... 179/100.41 K; 179/100.41 D

[58] Field of Search ..... 179/100.41 D, 100.41 K

[56] References Cited

U.S. PATENT DOCUMENTS

| | | | |
|---|---|---|---|
| 2,689,275 | 9/1954 | Hansen | 179/100.41 D |
| 3,040,136 | 6/1962 | Grado | 179/100.41 K |
| 3,230,318 | 1/1966 | Engel et al. | 179/100.41 K |
| 3,679,843 | 7/1972 | Cho | 179/100.41 K |
| 3,963,880 | 6/1976 | Ikeda | 179/100.41 D |

FOREIGN PATENT DOCUMENTS

| | | | |
|---|---|---|---|
| 98104 | 5/1924 | Fed. Rep. of Germany | 179/100.41 D |
| 1000035 | 8/1965 | United Kingdom | 179/100.41 K |

*Primary Examiner*—Raymond F. Cardillo, Jr.
*Attorney, Agent, or Firm*—Fleit & Jacobson

[57] ABSTRACT

A moving coil pickup of the type having a substantially square magnetic armature mounted in an air gap defined between two opposed pole faces of magnetic members in a magnetic circuit wherein the shape of the pole faces is conformed to the shape of the armature by making at least one end portion of at least one of the magnetic members substantially square in cross-section.

2 Claims, 6 Drawing Figures

MOVING COIL PICKUP HAVING A SUBSTANTIALLY SQUARE MAGNETIC ARMATURE MOUNTED IN AN AIR GAP ADJACENT A SQUARE FACE MAGNETIC MEMBER

The present invention relates to a pickup of the kind having at least one coil wound on a substantially square, magnetic armature which is movable in an air gap defined between two magnetic members of a magnetic circuit. Such a pickup is dynamic due to the moving coil, but it is also magnetic due to the fact that the magnetic field in the air gap is altered by movements of the coil support.

In the conventional moving coil pickups the pole piece constituting one of said magnetic members is circular in cross-section, this shape being preferable from a production point of view because of simplicity and cheapness in production. When, however, one side of a square armature during movements thereof brought about by the stylus approaches the circular face of the pole piece while the opposite side approaches the yoke, the resulting flux through the armature will be unevenly distributed tending to concentrate along the center area of the armature, because this area receives flux lines from a bigger area of the pole piece face than do the marginal areas of the armature. In connection with miniaturization of pickup units such an uneven flux distribution may lead to local saturation phenomena which have a harmful effect on the sound reproduction quality.

According to the present invention this drawback is overcome by means of a structure in which at least the end portion of at least one of said magnetic members adjacent the air gap is substantially square in cross-section. Due to the thus established conformity of the armature and said magnetic member the various portions of the armature will receive flux lines from equal areas of the end face of the magnetic member, so that the flux lines will be substantially uniformly distrubuted in the armature.

In a preferred embodiment of the pickup according to the invention both of the air gap defining end portions of said magnetic members are substantially square in cross-section, whereby the uniformity of flux line distribution in the armature is further improved.

A particularly light and compact magnetic system is provided in an embodiment, in which the air gap defining magnetic members are constituted by annular, square, permanent magnets.

Figure 1:
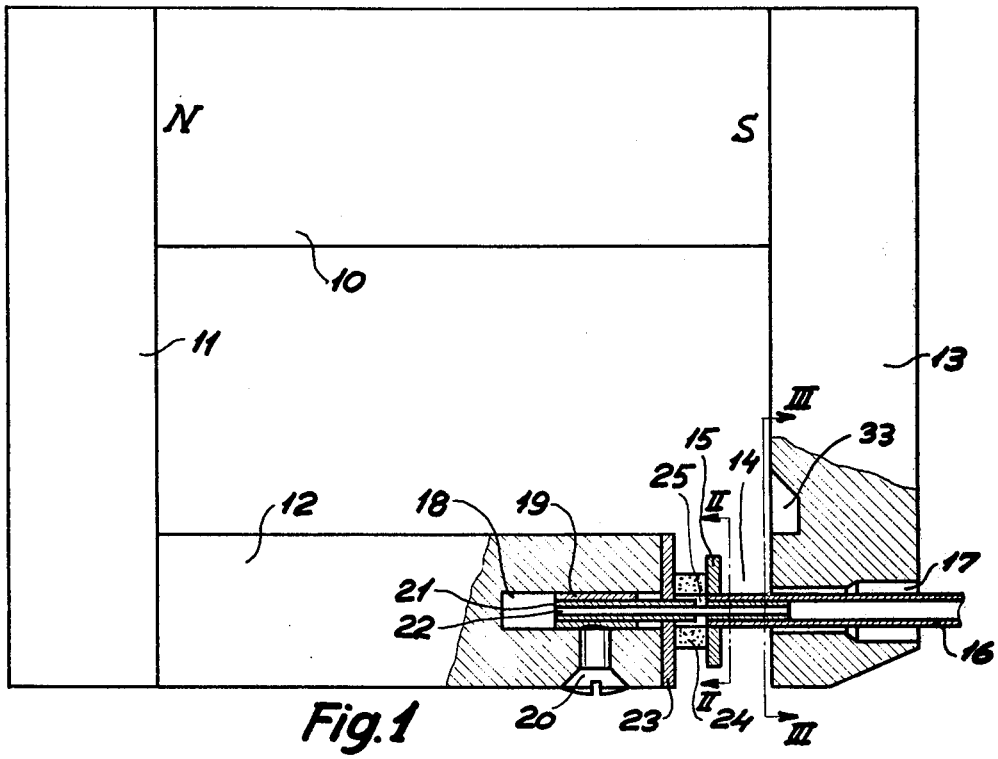
Figure 2:
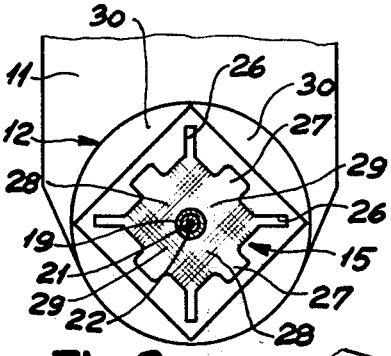
Figure 3:
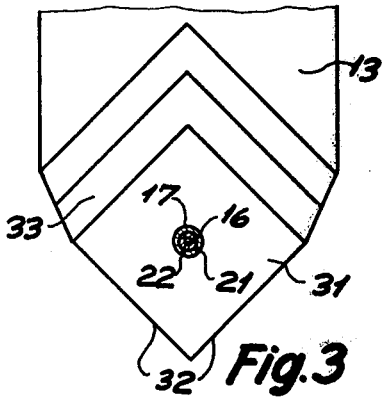
Figure 4:
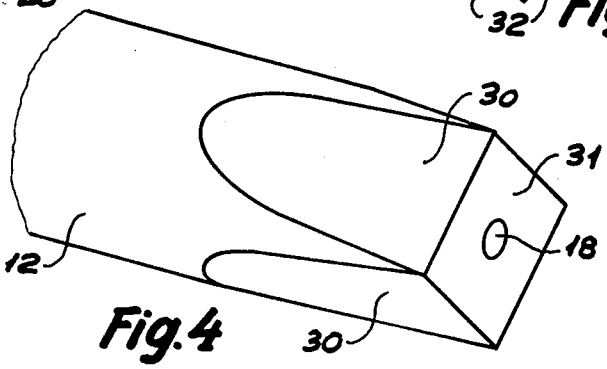
Figure 5:
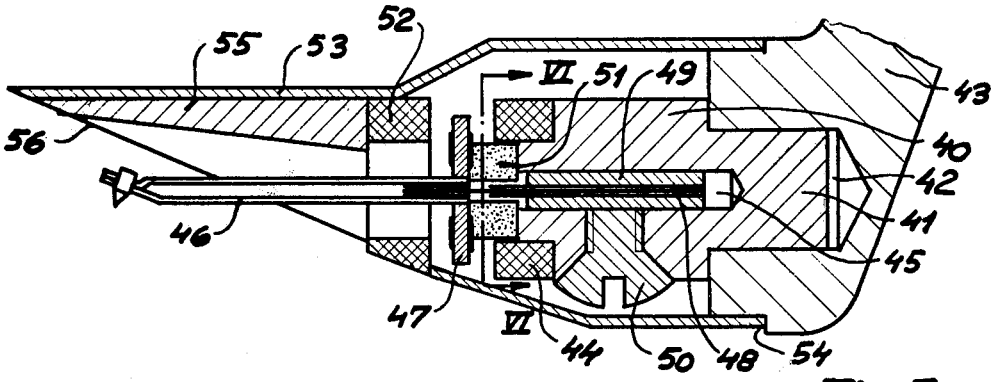
Figure 6:
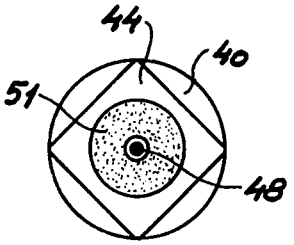

An embodiment of the pickup according to the invention will be described in a more detailed manner in the following with reference to the drawing, in which FIG. 1 is a side elevational view, partly in section, showing an embodiment of a stereo pickup unit according to the invention, FIG. 2 is a fragmentary sectional view on an enlarged scale as taken along the line II—II in FIG. 1, FIG. 3 is a fragmentary, sectional view on an enlarged scale taken along the line III—III in FIG. 1, FIG. 4 is a perspective view showing the free end of the pole piece, and FIG. 5 shows a vertical section through another embodiment of a stereo pickup according to the invention, FIG. 6 is a fragmentary sectional view as taken along the line VI—VI in FIG. 5.

In FIG. 1 a permanent magnet 10, a rear yoke 11, a generally cylindrical pole piece 12 and a front yoke 13 form a magnetic circuit which further includes an air gap 14 defined between one end of the pole piece 12 and the rear side of the lower end of the front yoke 13. In said air gap a magnetic, flat, generally square armature 15, which is fixed to the inner end of a tubular stylus arm 16, is pivotally mounted. The stylus arm 16 extends through a stepped bore 17 in the front yoke 13 and carries a stylus (not shown) on its outer end.

In a bore 18 in the free end of the pole piece 12 a sleeve 19 is held firmly by means of a screw 20, which is screwed into a threaded hole extending radially from the bore 18. To the inner side of the sleeve 19 a nickel coating 21 on a piano wire 22 is secured. The nickel coated wire 22 extends into and is secured to the inner side of the inner end of the stylus arm 16. On the end face of the pole piece 12 a cover disc 23 of plastic or elastomeric material such as butyl rubber, is mounted, and between said disc 23 and the armature 15 a rubber pad 24 having a center hole for the passage of the nickel coated wire 21, 22 is compressed by tension in the wire 22. In a small area 25 adjacent the inner face of the armature 15 the nickel coating 21 is interrupted to provide a pivot point allowing the armature to pivot in all directions.

As shown in FIG. 2 the generally square armature 15 is provided with projections 26 and 27 at its corners and at the center of its side edges respectively so as to form a bobbin on which two pairs of coils 28 and 29 extending at right angles to each other are wound.

As will also appear from FIG. 2 as well as from FIG. 4 parts of the end portion of the cylindrical pole piece 12 have been cut away along cut faces 30 in such a manner that the end face of the pole piece is made square and is aligned with the armature 15. By this measure is obtained that the magnetic flux lines passing through the armature between opposite side edges thereof upon deflection of the armature will be substantially uniformly distributed throughout the armature. In the conventional structure, wherein the end face of the pole piece is circular, the middle areas of the armature will receive flux lines from larger areas of the pole piece and face than the marginal areas of the armature, which results in an uneven flux line density in the armature.

As shown in FIG. 3 also the air gap defining area 31 of the front yoke 13 is made square corresponding to the end face of the pole piece 12. Said area 31 is defined downwards by the lower end faces 32 of the front yoke 13 and upwards by an angular groove 33 formed in the inner face of the yoke.

The principle of operation of a pickup of the type shown is well known by anybody skilled in the art and need not be further described here.

The pickup unit shown in FIG. 5 comprises a cylindrical body portion 40 made of iron or brass. At one end said body portion 40 is provided with a cylindrical projection 41 which is received in a bore 42 in a support member 43 of insulating material such as plastic. At the opposite end the body portion 40 is formed with an annular recess in which an annular, square, permanent magnet 44 is mounted. This magnet 44 extends axially beyond the end face of the body 40 as shown in FIG. 5.

An armature assembly similar to that shown in FIG. 1 and described above and consisting of a tubular stylus arm 46, a wound, square iron armature 47, a nickel coated piano wire 48, and a sleeve 49 is fastened in a bore 45 in the body portion 40 by means of a screw 50 in such a manner that the armature 47 is urged against an annular rubber pad 51 which is positioned between the armature and the end face of the body portion 40, within the projection portion of the annular magnet 44.

Coaxially with the body portion 40, the magnet 44 and the armature assembly and on the opposite side of the armature 47 to the magnet 44 another annular, square, permanent magnet 52 is mounted by means of a brass housing 53 which is secured in a circumferential recess 54 formed in the support member 43.

A non-magnetic support piece 55 for the magnet 52 is mounted in the upper front part of the housing 53. The stylus arm 46 extends through an opening 56 in the front portion of the bottom wall of the housing 53. The lower corner of the magnet 52 is levelled as shown in order to conform to the outline of the housing 53.

The structures shown in the drawing and described above are to be considered only as examplary embodiments of the invention, many modifications being possible within the scope of the invention.

I claim:

1. A pickup comprising a relatively flat magnetic armature having substantially square parallel side faces, at least one coil wound upon said magnetic armature, a pair of magnetic members of a magnetic circuit, one of said magnetic members comprising a cylindrical pole piece having a free end portion with a substantially square face, each of said magnetic members having a face, the faces of said magnetic members positioned substantially parallel to each other and spaced apart to define an air gap, means for positioning said magnetic armature in said air gap so that the side faces of said magnetic armature are substantially parallel to the faces of said magnetic members, at least one of the faces of said magnetic members being substantially square in cross section and in alignment with the substantially square side face of said magnetic armature.

2. A pickup comprising a relatively flat magnetic armature having substantially square parallel side faces, at least one coil wound upon said magnetic armature, a pair of magnetic members of a magnetic circuit, each of said magnetic members having a face one of which is a square face defined by a right-angled groove in one of said magnetic members, the faces of said magnetic members positioned substantially parallel to each other and spaced apart to define an air gap, means for positioning said magnetic armature in said air gap so that the side faces of said magnetic armature are substantially parallel to the faces of said magnetic members, at least one of the faces of said magnetic members being substantially square in cross section and in alignment with the substantially square side face of said magnetic armature.

* * * * *